US007179050B2

(12) United States Patent
Hopfensperger

(10) Patent No.: US 7,179,050 B2
(45) Date of Patent: Feb. 20, 2007

(54) RADIAL FAN

(75) Inventor: Reinhold Hopfensperger, Kroning (DE)

(73) Assignee: ebm-papst Landshut GmbH, Landshut (DE)

( * ) Notice: Subject to any disclaimer, the term of this patent is extended or adjusted under 35 U.S.C. 154(b) by 0 days.

(21) Appl. No.: 10/807,526

(22) Filed: Mar. 23, 2004

(65) Prior Publication Data

US 2004/0219013 A1 Nov. 4, 2004

(30) Foreign Application Priority Data

Mar. 24, 2003 (DE) ..... 103 13 054

(51) Int. Cl.
*F04D 29/42* (2006.01)
*F04D 29/30* (2006.01)

(52) U.S. Cl. ..... 415/204; 415/206; 415/211.1; 416/186 R; 416/228; 416/223 B

(58) Field of Classification Search ..... 415/204–206, 415/211.1, 211.2; 416/186 R, 223 B, 228
See application file for complete search history.

(56) References Cited

U.S. PATENT DOCUMENTS 2,658,455 A * 11/1953 Seinfeld ..... 416/181
2,752,856 A * 7/1956 Wolff et al. ..... 415/175
2,766,698 A * 10/1956 Carter ..... 415/58.3
2,995,293 A * 8/1961 Buchi ..... 415/199.2
4,231,706 A * 11/1980 Ueda et al. ..... 416/186 R
5,964,576 A * 10/1999 Fujita et al. ..... 415/206
6,224,335 B1 5/2001 Parisi et al.
2002/0106277 A1 8/2002 Chapman

FOREIGN PATENT DOCUMENTS

| | | |
|---|---|---|
| DE | 3310376 | 9/1984 |
| DE | 4000072 | 7/1991 |
| DE | 41 41 359 | 6/1993 |
| DE | 4232178 | 12/1993 |
| DE | 0 627 560 | 12/1994 |
| DE | 0 741 246 | 11/1996 |
| DE | 29818179 | 3/1999 |
| DE | 100 17 808 | 6/2001 |
| DE | 10231983 | 6/2003 |

* cited by examiner

*Primary Examiner*—Ninh H. Nguyen
(74) *Attorney, Agent, or Firm*—Harness, Dickey & Pierce, PLC

(57) ABSTRACT

The invention relates to a radial fan with a casing and in it an axially placed wheel, wherein the casing has an axially placed air inlet, an exhaust (5), a bottom section (6) with a bottom reference surface (7) arranged orthogonally to the axis and a spirally shaped compression space located radially around the wheel that extends to the exhaust port; and wherein the wheel has a cover disk that faces the air inlet port and a supporting disk; wherein the radial fan is characterized in that the spiral-shaped compression space (8) expands both in a radial direction from the axis towards the exhaust port (6) as well as in an axial direction; wherein the axial expansion extends over at least 180° of the spiral circumference; and in which a hollow cylindrical cup-shaped section (9) is recessed in the bottom section (6) in an axial direction beyond the bottom reference surface (7) into which the wheel is placed in such a way that an inside of the supporting disk of the wheel runs flush with the bottom reference surface (7).

19 Claims, 6 Drawing Sheets

RADIAL FAN

FIELD OF THE INVENTION

The invention relates to a radial fan with a casing and in it an axially placed air inlet, an exhaust, a radially and axially expanding compression space and a cylindrical hollow cup section for inserting a wheel.

BACKGROUND OF THE INVENTION

Radial-flow fans of this kind take in air, another gas such as methane or an air-gas mixture from a working environment and convey it whilst both the flow rate as well as the pressure of the medium transported rises.

The primary intent of this type of fan is to improve the fan power performance characteristic and to adapt it to the desired application. There is also a great need for radial fans that at the specific fan power performance characteristic that is as high as possible at the same time produce little noise since these types of radial fans are frequently used in places in which noise is perceived as unpleasant. Various measures have been proposed in the state-of-the-art to improve the performance characteristic and at the same time reduce the noise levels of fans. For example there are radial fans known in which between the tab of the casing and the fan wheel a wedge-type gap is provided for this purpose at the tab which considerably reduces running noise.

Different tab shapes are known which are also designed to reduce running noise, the so-called turning sound that occurs in particular when the blades of the fan wheel rotate past the tab.

A radial fan is known from German Patent DE 100 17 808 A1 that has inlet vanes in the compression space to direct the air flow in the compression space to the exhaust. This allows for a higher specific fan power. This in turn also reduces noise development. With regard to other necessary increases in efficiency and ever stricter requirements in the area of noise development, this arrangement, however, is also in need of improvement.

SUMMARY OF THE INVENTION

It is thus the object of the present invention to provide a radial fan that exhibits improvements vis-à-vis the known radial fans which are achieved by suitable means in all properties, e.g. by reducing the noise level while maintaining high efficiency.

This object is attained by providing a radial fan as claimed in independent patent claim 1. Other advantageous arrangements, aspects, and details of the present invention result from the dependent claims, the description, and the attached drawings.

The invention relates to a radial fan with a casing and an axially placed wheel in it, wherein the casing has an axial air inlet port, an exhaust port, a bottom section with a bottom reference surface arranged orthogonally to the axis and a spirally shaped compression space located radially around the wheel that extends to the exhaust port; and wherein the wheel has a cover disk that faces the air inlet port and a supporting disk; and which is characterized in that the spiral-shaped compression space expands both in a radial direction from the axis towards the exhaust port as well as in an axial direction, wherein the axial expansion extends over at least 180° of the spiral circumference; and that a hollow cylindrical cup-shaped section is recessed in the bottom section in an axial direction beyond the bottom reference surface into which the wheel is placed in such a way that an inside of the supporting disk of the wheel extends flush with the bottom reference surface.

Two aspects characterize the fundamental wheel fan in accordance with the invention. On the one hand, there is the flush alignment of the air outlet ports of the fan wheel with the so-called bottom reference surface. This is generally defined as the surface of the bottom if said surface did not exhibit any recesses in the form of a hollow cylindrical cup and (optional) the compression space extension. The air taken in by the wheel during operation can thus be expelled directly into the air space without first having to overcome any obstacle. On the other hand, this arrangement prevents air expelled from the wheel to a great extent from reaching the supporting disk of the wheel which would reduce the efficiency of the air transport.

Another aspect of the invention is that it optimizes the shape of the compression space that extends to the exhaust port. In the state-of-the-art, spiral-shaped compression spaces are known that expand in a radial direction, i.e. the further they are from the wheel, towards the exhaust port.

An additional expansion of the compression space allows for a larger volume flow at the same differential pressure. Given the special arrangement of the wheel an optimal conduction of air in the hollow cylindrical cup and the compression space expansions is made possible from the wheel into the compression space with the result of a high specific fan power.

Axis or axially placed is to be construed within the meaning of the present invention as the rotational axis of the wheel or the imaginary center of rotation of the air in the spiral-shaped compression space.

The bottom reference surface is an imaginary surface which would be the inside surface of the casing if the bottom did not have any recesses like the hollow cylindrical cup and/or the axial extension of the compression space. The bottom reference surface will be used as the reference surface to describe various elements of the radial fan according to the invention. The radial direction within the meaning of the present invention is a direction that extends radially away from the axis.

The axial direction is a direction that progresses parallel to the axis in one of two possible directions.

Tangential directions within the meaning of the present invention are those that represent tangents of an imaginary or actual circumference.

Advantageously the wheel is set into the hollow cylindrical cup-shaped section in such a way that between the circumference of the supporting disk which is completely recessed in the cup-shaped section and the side walls of the cup-shaped section a minimal, as small as possible gap is left whose width is a consequence of the precise motion of the wheel as it turns.

Other characteristic features for a radial fan of improved efficiency can be added in further developments of the invention in order to continue to improve the performance characteristic of the fan so obtained through the addition of synergistic effects.

The compression space extends advantageously in an axial direction beyond the bottom reference surface. In this way, the compression space expansion is situated next to the hollow cylindrical cup-shaped section since both extend in the same axial direction. The compression space is bordered in the radial expansion section by a wall that defines the bottom periphery. Alternatively or additionally, the compression space can also extend in an axial direction into the cover section of the casing.

It is advantageous that the wheel has blades that have a swept-back outer edge along the wheel circumference. This design of the outer edge of the blade which, for example, may have the point (blade tip) that extends farthest outward approximately in its middle, causes the air conducted by the blades to be exhausted at an angle that prevents the entire air front from impinging synchronously on the casing wall and thus reduces operating noise.

It may also be advantageous that the outer edges of the blade extend beyond the circumference of the wheel cover disk and/or the wheel supporting disk in a radial direction.

In a preferred embodiment, the blades are curved backwards in relation to the wheel's operating direction of rotation in order to provide efficient air exhausting from the blade spacing of the wheel.

The outlet angle which forms a tangent on the outer edge with a tangent on the circumference of the wheel at the point on the outer edge is preferably =35°, for example 25–30° and 22° in a particularly preferred embodiment.

The entrance angle that forms a tangent on an inner edge of the blade with a tangent on the circumference of the wheel at the point on the inner edge is preferably 17–35°, in particular, this starting angle can be 24°.

Additionally or alternatively to the backward placement of the blades, said blades can be curved in an S-shape when observed from a top view (on the wheel or the air inlet), wherein the outlet angle is then preferably approximately 90° and the air output is increased with lower efficiency.

All blades on a wheel may be the same length and thus begin or end on the circumferences in regard to the axis of rotation of the wheel which are the same size for all blades. In another preferred embodiment, shorter and longer blades are alternated in the wheel wherein the outer edges are all situated on the same circumference and the inner edges of the blades are offset radially.

Advantageously a tab is placed in the casing that largely extends in the circumferential direction in the compression space and a guide edge formed by the tab in a lateral projection forms various angles with the bottom reference plane of the fan as it progresses. In other words, a tab extends radially to the wheel in the casing from the casing wall between the section in which the wheel turns and the exhaust port in order to carry off the air flow in the compression space through the exhaust port without allowing too much of the air to be conducted again by the turning wheel. A tab of this kind is primarily for separating the compression space from the remaining casing space, i.e. the section of the casing under pressure that is lower than the pressure at the end of the compression space in front of the air exhaust port. The tab is designed to prevent a short-circuit flow. This measure also completes the funnel-shape of the compression space and additionally increases the air output. The non-linear progression of this guide edge produced by the varying angles of said edge is a particularly advantageous shape in regard to the efficiency and noise reduction of the wheel fan as defined by the invention. The tab has a minimum and a maximum height on the wall across from the air inlet port so that it has an inclined approach ramp which is extremely important for the effect.

The tab would fulfil its task to prevent a short-circuit flow best if it were placed as close to the wheel as possible. In this case, however, the disadvantage of massive noise development would have to be accepted. Thus, all effort is being made to design the tab in such a way that an achievable minimal or optimized noise development is accomplished while simultaneously preventing short-circuit flow as far as possible.

In this context, the inventors have found that using steps and plateaus and combinations thereof is particularly advantageous in the guide edge. It is thus preferred that the guide edge constitutes at least one step in lateral projection in which the angle to the bottom reference surface is essentially 90° over a section of the guide edge.

It is also preferred that the guide edge forms at least one plateau in lateral projection in which the angle to the bottom reference surface is essentially 0° over a section of the guide edge.

Combining the two characteristics produces a projection in the guide edge that almost has a right-angled tip. In typical radial fans with a wheel diameter of e.g., 12 cm, the vertical section of the guide edge may have e.g., a height of 4 mm while the plateau approximately 12 mm over the bottom reference surface extends over a length of approximately 18 mm. The inclined section of the guide edge can, e.g., measure 20 mm measured from its beginning at the bottom reference plan to the step while the height of the plateau to the upper end of the guide edge, e.g., can measure 16 mm.

It is possible to arrange several steps and plateaus to create a stair-like structure on the guide edge.

It is also particularly advantageous when the guide edge has a bump, in particular in combination with certain wheel shapes. It is preferred for example that the wheel include blades that have swept-back outer edges on the wheel circumference (cf. above) and that the blade tip on the outer edge of the blade does not have the same orthogonal (measured in a right-angled direction) distance to the bottom reference plane as a tip of a bump on the guide edge. The relative arrangement of the blade tip and the bumps is offset and helps reduce noise. This arrangement is preferred particularly when the bumps or the corner of the step are the same height which amount to approximately two thirds of the height of the blade measured from the supporting disk to the cover disk.

It can also be advantageous when the inclination of the outer edge of the blades of the wheel form an angle with the guide edge that is greater than 0°, i.e., when they do not run parallel. This can either apply in regard to every tangent pair of points on the outer edge and points on the guide edge with the same orthogonal distance to the bottom reference surface or for average ascending lines from outer edge and guide edge seen either as a whole or in part, for example, to the bumps and from the bumps to the upper edge or from the wheel supporting disk to the blade tip and from the blade tip to the wheel cover disk.

Another measure designed to improve flow efficiency is that the casing has a cover and an air conduction ramp is arranged on the cover which produces a steady transition between cover and exhaust port. Thus, the air conduction ramp is preferably placed in the vicinity of the cover which is situated directly at the air export port. An arrangement of this kind is particularly useful when the entire opening of the exhaust port is in the casing and otherwise an edge created by the frame of the opening would be unavoidable. This type of a conduction ramp is not absolutely necessary in arrangements in which the exhaust port is also divided between casing and cover or the cover is approximately the same size as the other part and consequently two casing halves can be referred to.

It is advantageous that the cover disk of the wheel has an axially placed air intake port and the cover disk on the wheel of the air intake port is bulging in an axial direction to the casing and a U-shaped profile is provided at the circumference of the air intake port that seals off the edge of the air intake port. Through this arrangement of the cover disk of the wheel and air inlet, an undesirable strong bypass flow of air can be prevented through the gap that otherwise exists between the wheel and the air inlet.

The radial fan can also have guiding means in the compression space for directing an air current in the compression space to the exhaust. The guiding means can for example have at least one exhaust bulb and one inlet bulb. The exhaust bulb is arranged on at least one casing wall between the exhaust (or its port) and the air inlet. The exhaust bulb prevents the air flow at least in part from being sucked into the compression space section of the air inlet by the rotating fan wheel.

In certain embodiments, the inlet bulb starts at the internal radius of the exhaust bulb and largely follows an imaginary ideal flow path radially out. In this way, the air taken in and in the fan casing is not only directed through the blades of the fan wheel, but also through corresponding flow lines to the free compression space whilst mixing with air that has already been taken in and compressed. The inlet bulb can have its minimum height in the vicinity of the air inlet and its maximum height in the vicinity of the exhaust.

It can be particularly advantageous when the air inlet bulb has a spatially curved guide vane. In this way, the medium taken in is conducted optimally.

In embodiments with a cover in which the radial fan according to the invention is equipped with a two-part casing, in which the casing is divided in a plane parallel to the rotational plane and the casing circumferential wall is largely arranged over its entire width on one of these parts, it can be particularly beneficial that the inlet bulb and the exhaust bulb are arranged as a largely one-piece elevation on the part of the casing largely formed as a flat cover.

It is advantageous that the bottom of the hollow cylindrical cup has a slanted, inclined or bulged shape so that the hollow in the axial area is smaller. Through the bulging of the cup bottom, the stability of the casing is improved in this area.

The radial fan according to the invention is preferably used in integrated systems which in addition to radial fans consist of other interacting components. There are pneumatic integrated systems in which the control occurs pneumatically through low pressure, electrical integrated systems in which in the case of a gas burner, a probe measures the exhaust gas and a computer calculates and controls the gas supply electrically; and mass flow integrated systems in which the air mass and the gas mass are measured and controlled by computer.

BRIEF DESCRIPTION OF THE DRAWINGS

The invention is described below in greater detail with reference to the drawings and on the basis of exemplary embodiments. In the drawings show.

DETAILED DESCRIPTION OF THE PREFERRED EMBODIMENTS

Figure 1:
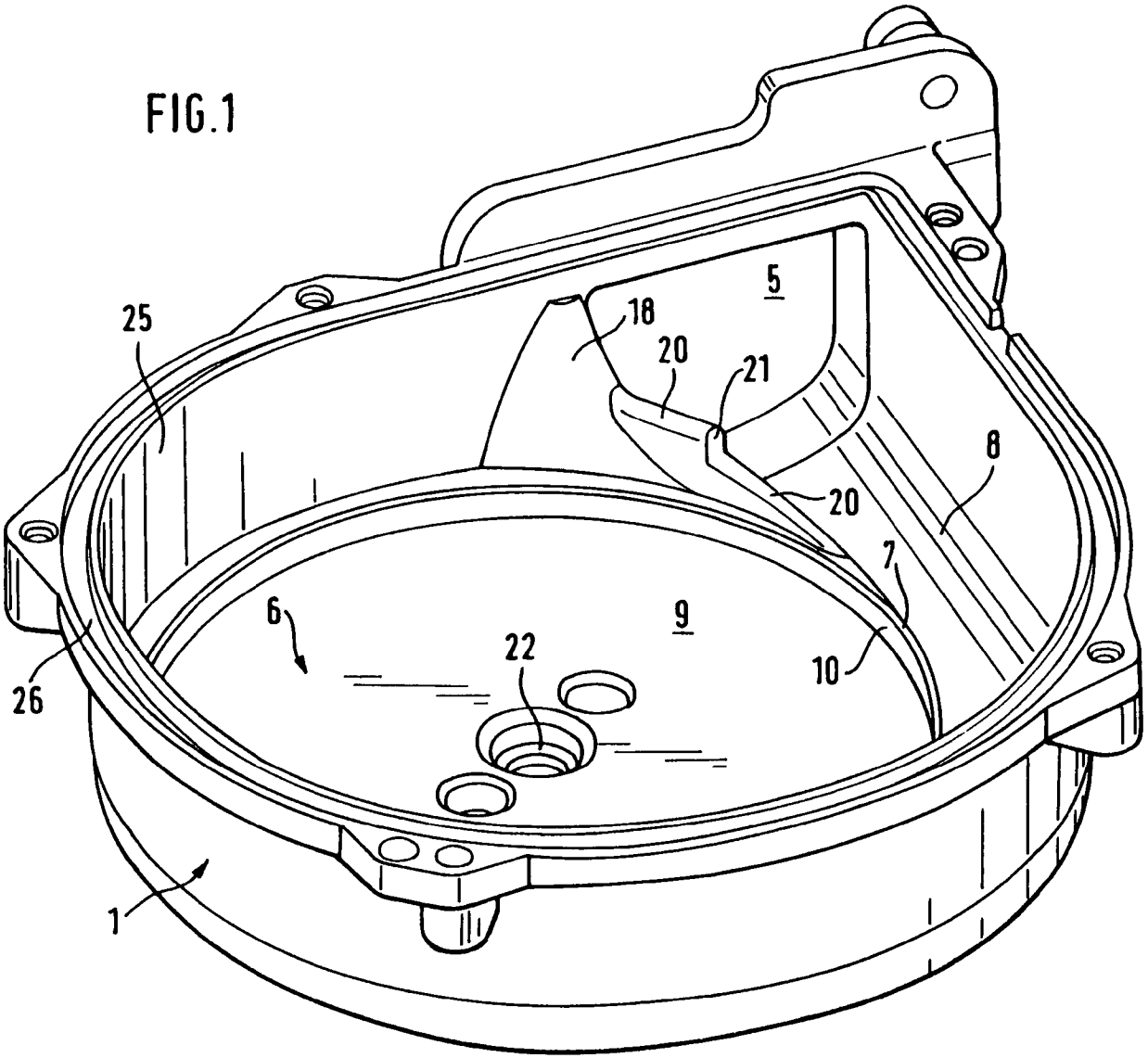
FIG. 1 a perspective view of a casing according to the invention with a view to its interior and the exhaust.

In FIG. 1, the casing 1 of a radial fan is shown in a perspective plan view of the interior. The radial fan has a detachable cover 2 (FIG. 3) on the casing as well as a fan wheel 3. The bottom section 6 of the casing 1 is surrounded by a spiral-shaped compression space 8. The compression space 8 is widest in a radial direction at an exhaust 5 and narrows in a spiral shape along the bottom section 6 as it extends away from the exhaust 5. In addition to the compression space 8, the bottom section 6 consists of the bottom reference surface 7 and a hollow cylindrical cup-like section 9 that is recessed relative to bottom reference surface 7 which in part is used to take up the wheel 3. An opening 22 in the axis of the bottom section 6 is used for the lead through of a driving shaft (not shown) to turn the wheel 3.

Also recessed vis-à-vis the bottom reference surface 7, i.e., extending beyond the reference surface in an axial direction, the compression space 8 has an axial extension that extends over the entire or essentially entire section of the compression space 8, in particular where a radial extension of the compression space 8 is spiral in shape. In this way larger compression spaces can be produced in a radial direction without increasing the fan dimensions. The larger compression spaces improve the performance characteristic of the radial fan due to the improved air intake.

The wheel fan according to the invention is further provided with a tab 18. This tab 18 essentially extends in a circumferential direction into the compression space 8. The tab 18 has a guide edge 20 that has a continuous non-linear curvature, wherein sections of the guide edge 20 have different gradients. Thus, the guide edge 20 encompasses varying angles in sections over its entire length with the bottom reference surface 7 of the fan. The tab 18 has a minimum height at the wall across from air inlet 4 and a maximum height in the vicinity of the exhaust 5. The extension can, for example, have a projection or one or several steps 21, for example, approximately in the middle of the guide edge as a manifestation of the different angles.

A groove 26 running along one side 25 of the casing is used to hold an O-ring seal used to seal casing 1 and cover 2.

Figure 2:
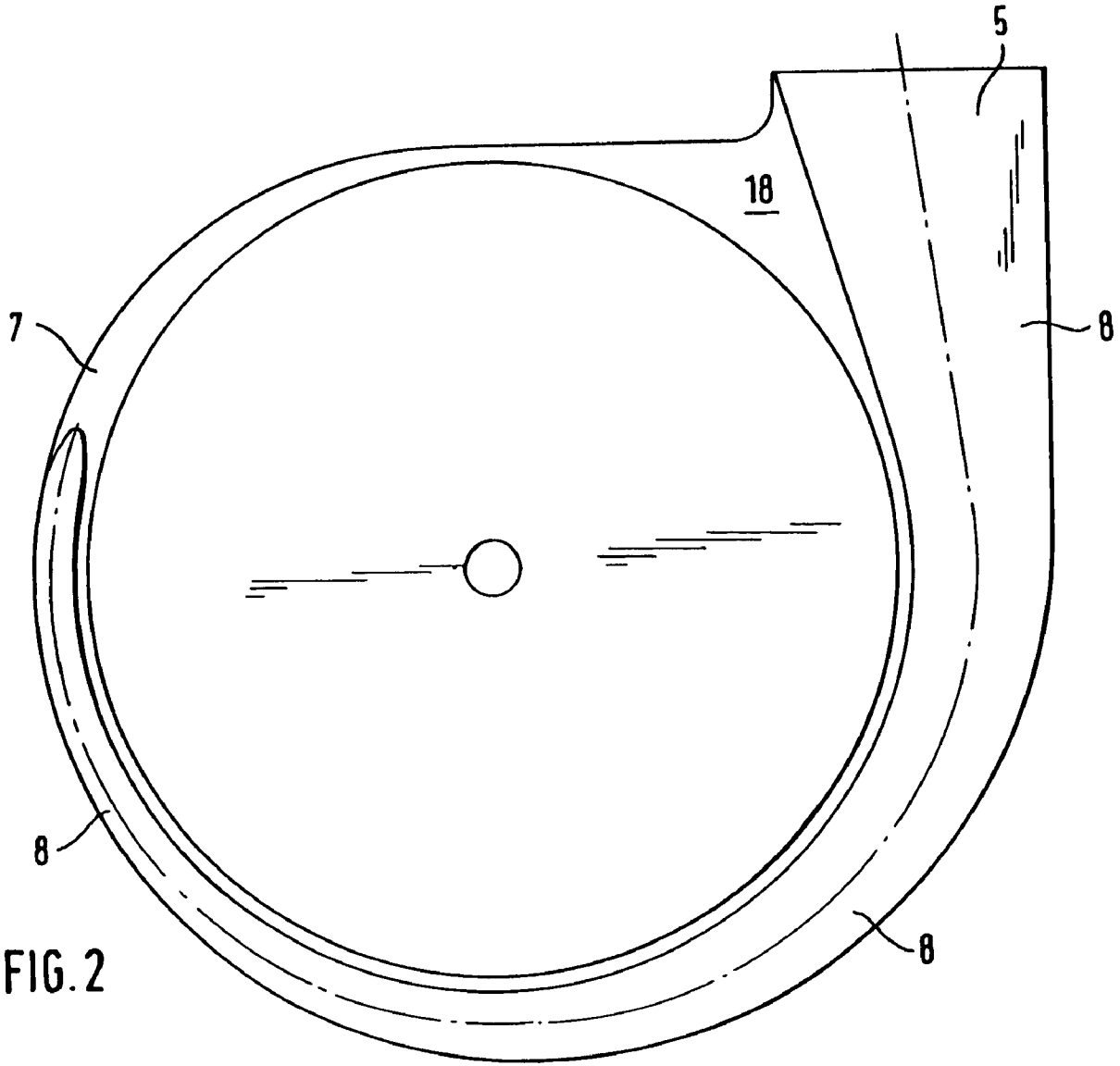
FIG. 2 a plan view of the casing according to the invention in FIG. 1.

FIG. 2 shows the casing 1 of an embodiment of the radial fan of FIG. 1 in a plan view. Like elements are marked with like reference numbers so that a separate description of each element is not required. In this view, the compression space 8 is readily identifiable over its entire spiral-shaped length and it is also apparent that the axially oriented compression space extension (specifically, extending beyond the bottom reference surface and recessed in bottom 6) essentially extends over the entire length of the compression space 8, preferably over more than 180° of the compression space volume.

Figure 3:
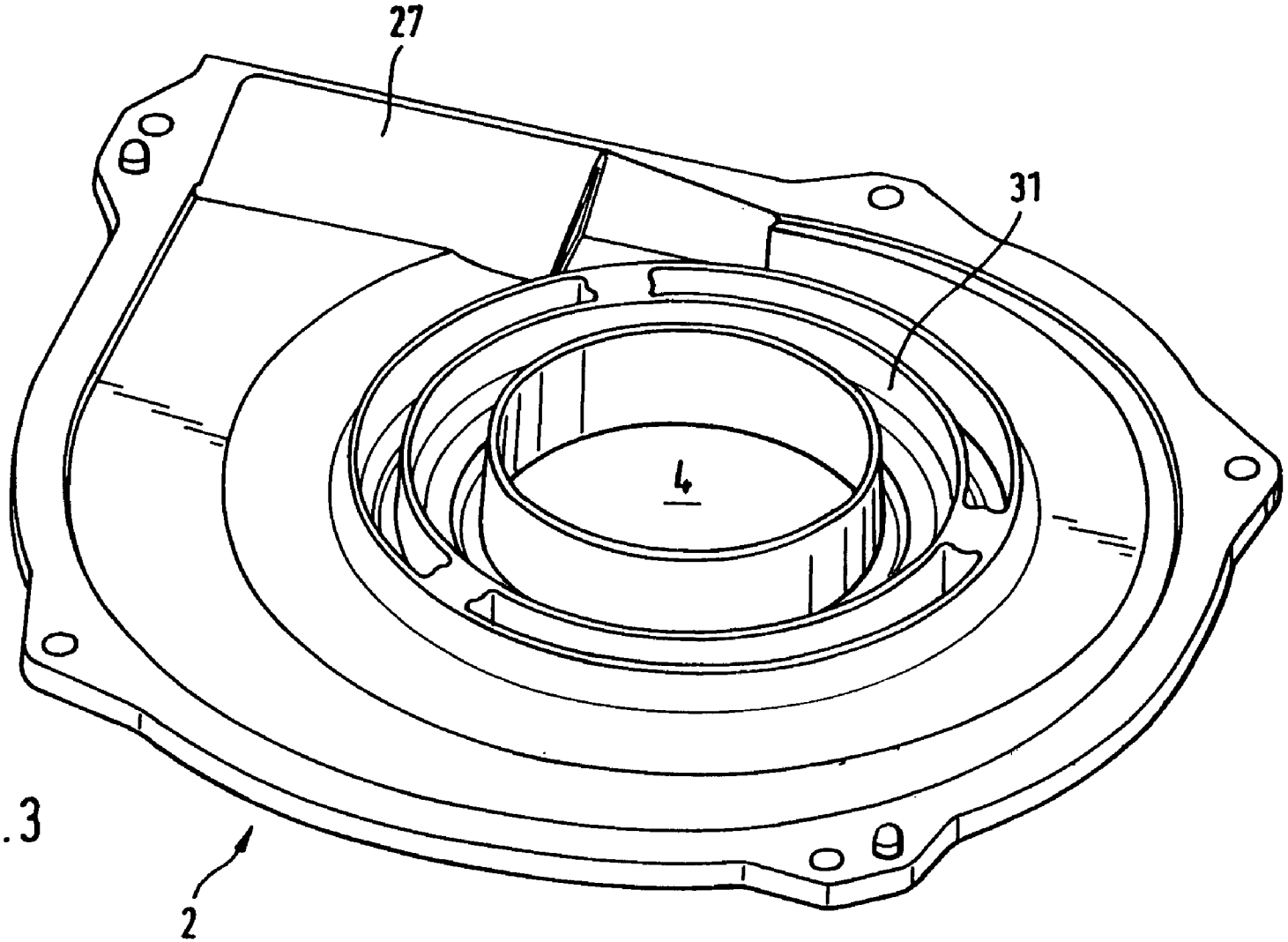
FIG. 3 a perspective view of the cover of the casing with guiding means and a guiding ramp.

FIG. 3 shows a cover 2 intended for use with casing 1 in FIG. 1 and 2. An air inlet 4 is used to take in air by the wheel. A ramp 27 is arranged in such a way that it can bridge without edges the gap between the upper edge of the side wall 25 of the casing 1 and the opening of the exhaust 5 (cf. FIG. 1). In this way, eddies and/or backpressure can be avoided along this edge. In other embodiments of the present invention, an edge of this kind can be avoided in a different way than ramp 27.

Figure 4A:
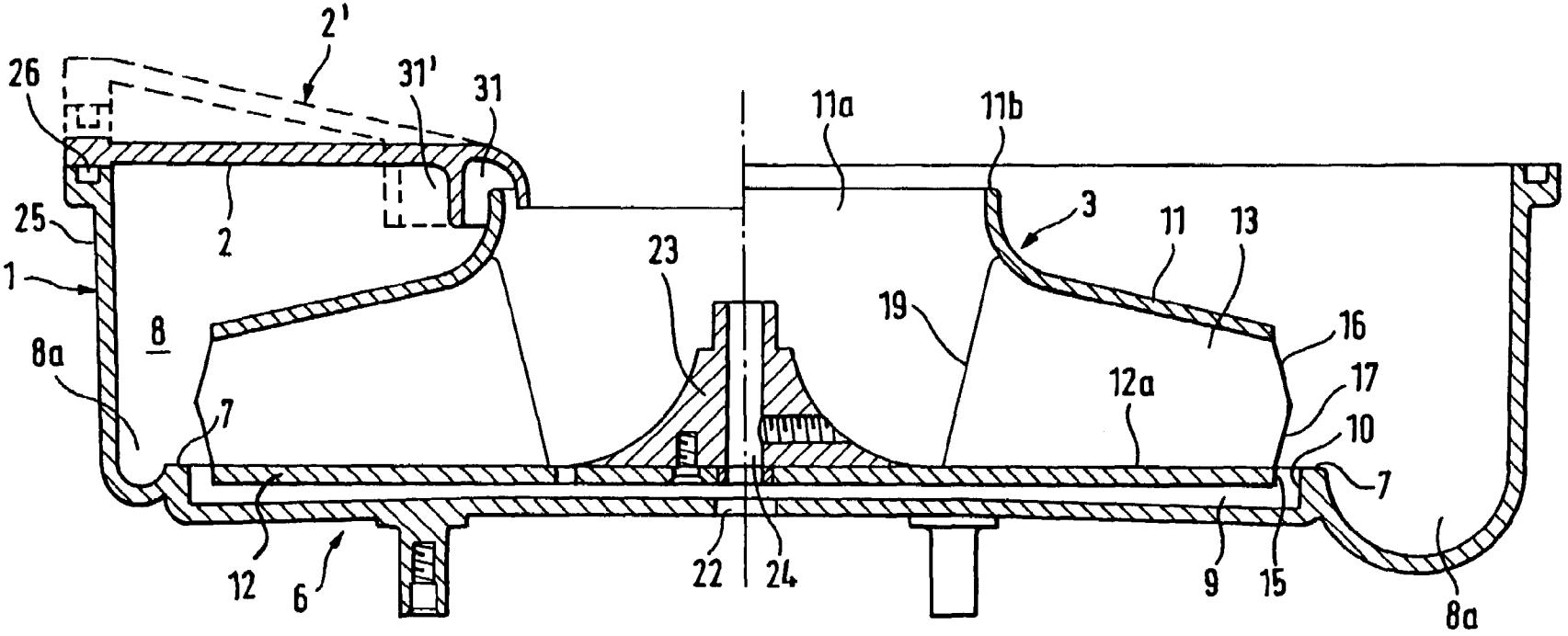
FIG. 4*a* a cross-sectional view through a casing with the wheel inserted and ready to run.
Figure 4B:
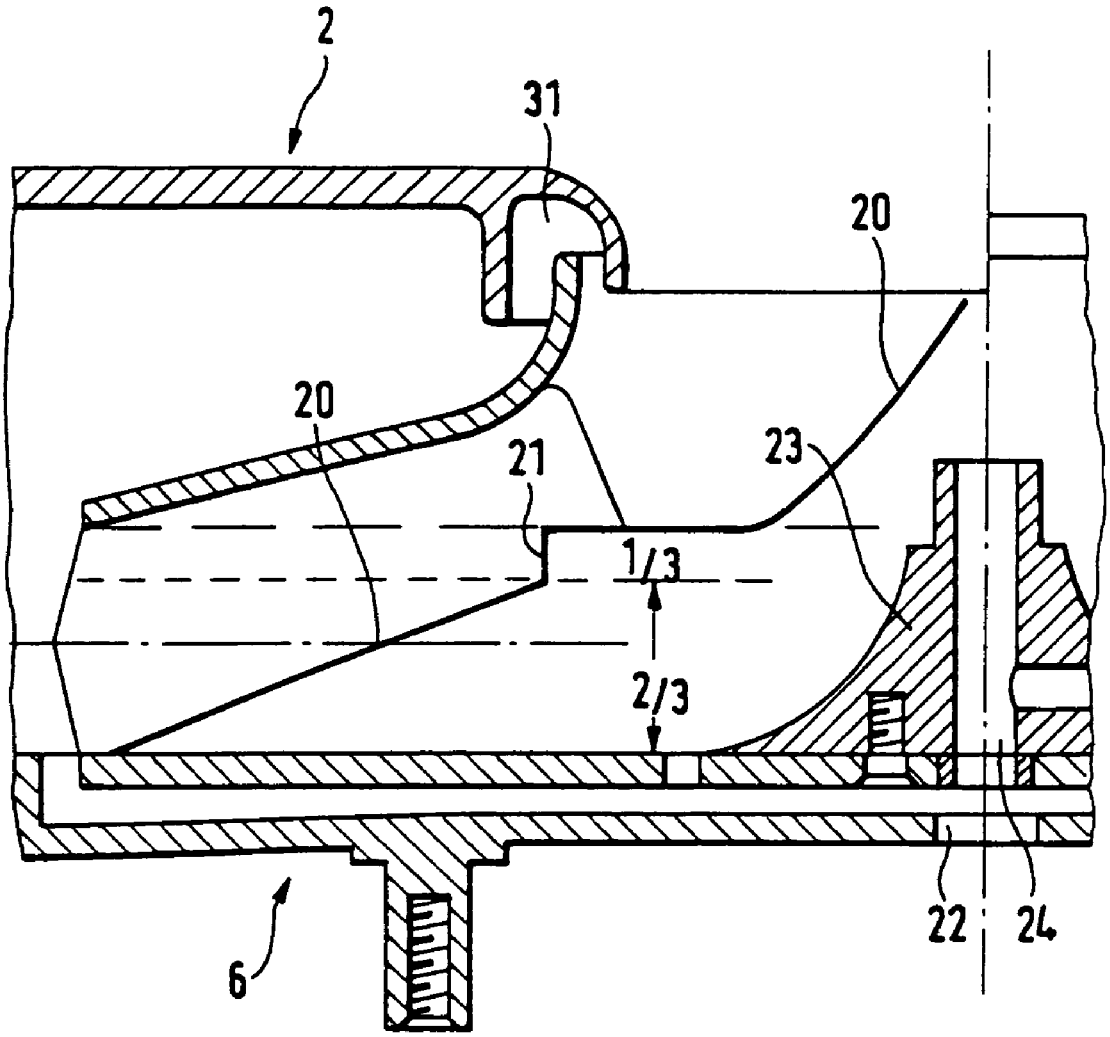
FIG. 4*b* a cross-sectional view through a casing with the wheel and tab formation inserted and ready to run.

In FIGS. 4*a* and 4*b*, both the casing 1 and the cover 2, as well as the wheel 3 and the location of the tab with respect to the blade geometry is shown in a sectional view. The compression space 8 extends over the majority of the casing in a spiral and radially around the wheel 3 and can be seen in the left and right section of FIG. 4*a*. An axial extension 8*a* of the compression space 8 extends beyond the bottom reference surface 7 that is narrow and flat at the beginning of the air space 8 (facing away from the exhaust port 5) and then widens and grows deeper as it proceeds around the casing 2 both as part of the radial compression space extension as well as due to the axial extension (cf. right section of FIG. 4*a*). The cover 2 that closes off casing 1 can be designed to meet assembly requirements and to suppress other sympathetic oscillations. As demanded, at least three tapped holes are provided on the cover 2' in the vicinity of the intake port. So that geometry of cover 2' resulting from the required material accumulation for the depth of screw engagement does not cause any difficulties during production of the cover nor have a negative impact on the flow conditions in the compression space, the material enlargement is rendered in a circumferential groove 31' that opens to the inside so that a type of labyrinth seal is produced. In this way, the strain distribution in the cover is much more balanced during production, and it provides an additional seal against the inlet port. In this embodiment, the cover may take the shape of a type of plate, whereby an additional radial extension for the compression space is produced.

The wheel 3 consists of blades 13 and a root of the blower 23 in addition to the cover disk 11 and the supporting disk 12. As can clearly be seen in the illustration, the supporting disk 12 stays in alignment on its inside 12*a* with the bottom reference surface 7 of the cup-like section 9. A minimum gap between circumference 15 of the supporting disk and the inner wall 10 of the hollow cylindrical cup 9 is desired in order to minimize air eddies and air intake in the air space formed between the bottom of hollow cylindrical cup section 9 and supporting disk 12. The blades 13 are curved backwards. The blades 13 are swept-back at their outermost end and extend with a tip 17 beyond the diameter of the supporting disk. In preferred embodiments of the invention, the tip 17 is not located at the same height above the bottom reference surface 7 like the projection 21 shown in FIG. 1 or its tip.

As shown in FIG. 4*b*, the tab 18 rises out of the bottom reference surface 7 with a specific angle so that the tab edge runs essentially rectilineal up to a height of ⅔ of the outlet width of the wheel. This first section extends over an area of approximately 20 to 40 mm, depending on the wheel diameter. This first section is essentially joined to an essentially vertical step the height of which amounts to approximately ⅓ of the outlet width. This step follows an essentially horizontal tab section that is in proportion to the outlet width, in this case approximately 1.5× outlet width. The last section of the tab has a relatively steep gradient.

The inner edge 19 of the blades 13 are preferably inclined vis-à-vis a vertical from the supporting disk 12, preferably at an angle between 80 and 60°, for example, as shown here, 76°. The root of the blower 23 has an axial duct 24 which is arranged axially above the opening 22 and is used for the lead through of a driving shaft.

A U-shaped profile 31 is placed in the cover 2 on the circumference of the air inlet 4 into which a bulged inside edge 11*b* of the cover disk 11 engages in such a way that a labyrinth seal is produced which is to minimize a bypass of air from the compression space 8 back to the air inlet 4.

As can be seen in the drawing, the bottom of the hollow cylindrical cup-shaped section 9 is bulged to improve stability. It is hereby also achieved that the surface area has a reduced ability to oscillate and sympathetic oscillations are reduced. The cavity formed between the supporting disk 12 and bottom in the vicinity of the axis can be kept small whereby pressure losses are avoided.

Figure 5:
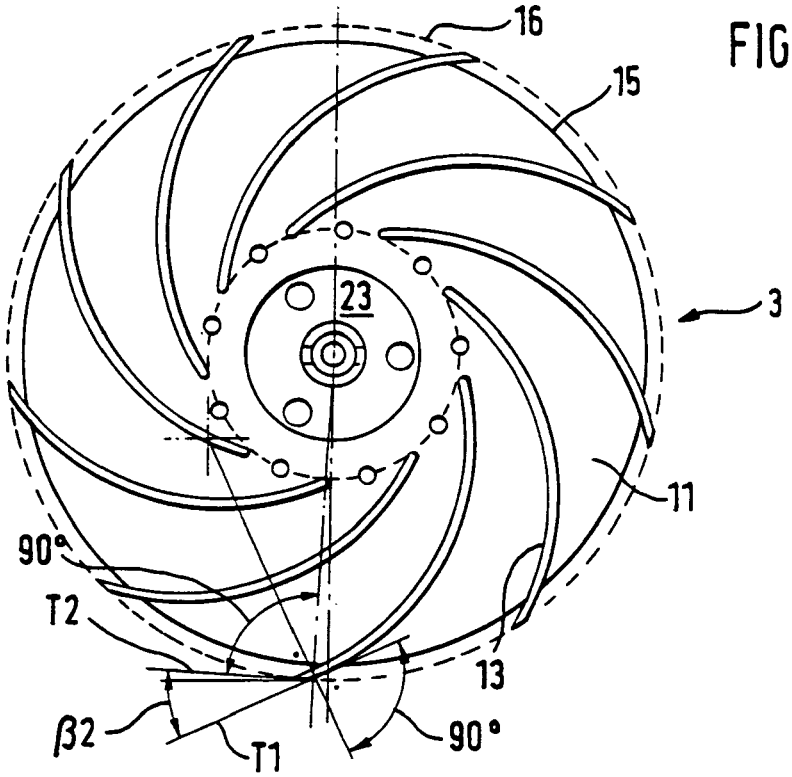
FIG. 5 a wheel with its blades in a plan view without cover disk.

FIG. 5 shows a wheel 3 in a plan view in accordance with an embodiment of the present invention. The supporting disk 11 with circumference 15 and blades 13 and the root of the blower 23 are shown. The blades are directed backwards in the direction of motion and extend beyond the circumference 15 at their outer edges. A free section remains in the center in order to take air in with as little friction as possible. A tangent T1 adjacent to a blade 13 cuts an escribed tangent T2 adjacent to the same point on the outer edge circumference of the blades with an angle □2 that is preferably smaller than 35°, for example, between 25° and 30°.

Figure 6:
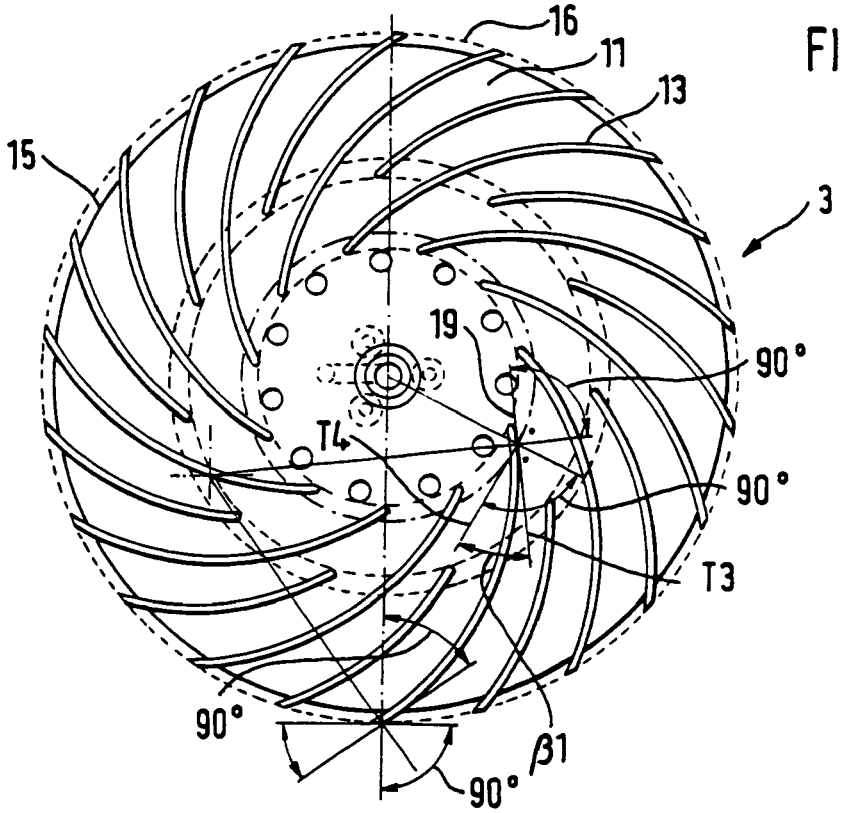
FIG. 6 a wheel according to another embodiment with its blades in plan view without cover disk.

FIG. 6 shows another embodiment of a wheel 3 in accordance with the present invention. A tangent T3 adjacent to the inner edge 19 on the wheel 13 cuts an escribed tangent T4 adjacent to the same point on the radius of the inner edge with an angle □1 which in the preferred embodiment is between 17° and 35° (cf. FIG. 6).

The arrangement of the elements is similar to the arrangement depicted in FIG. 5 so that no further description is given here. In addition to the blades 13 that extend far inward, other shorter blades 14 that are positioned farther out are arranged in the wheel 3 which improve the conducting of air between the individual blades.

The present invention provides a radial fan for conveying air or air-gas mixtures, for example for burners for building heating systems in which through a synergistic combination of properties, the efficiency vis-à-vis previously known fan shapes is improved. Nonetheless, the fan as embodied in the invention has a simple structure, consisting of a number of structural members which correspond to those found in state-of-the-art fans. The positive effects are produced by the characteristic features and their skilful placement and relative arrangement.

What is claimed is:

1. Radial fan with a casing (1, 2) and in it an axially arranged fan wheel (3), wherein the casing has an axially placed air inlet (4), an exhaust (5), a bottom section (6) with a bottom reference surface (7) and a spiral-shaped compression space located radially around the wheel that extends to the exhaust and which expands both in a radial as well as an axial direction towards the exhaust (5);

and the wheel (3) has a cover disk (11) facing the air inlet (4) and a supporting disk (12);

wherein an axial and radial extension on the casing is formed over at least 180° of the spiral circumference; and a hollow cylindrical cup-like section (9) is recessed in the bottom section (6) in an axial direction extending beyond the bottom reference surface (7) in which the wheel (3) is placed in such a way that an inner side (12*a*) of the supporting disk (12) of the wheel (3) is flush with the bottom reference surface (7), a tab (18) is placed in the casing (1) which essentially extends in the circumferential direction in the compression space (8), and a guide edge (20) formed by the tab (18) in a lateral projection forms different angles with the bottom reference surface (7) of the fan.

2. Radial fan as claimed in claim 1, characterized in that the compression space (8) expands in an axial direction beyond the bottom reference surface (7).

3. Radial fan as claimed in claim 1, characterized in that the casing has a cover (2) and the compression space expands in an axial direction into the cover (2).

4. Radial fan as claimed in claim 1, characterized in that the wheel (3) has blades (13, 14) that have a swept-back outer edge (16) along the wheel's circumference (15).

5. Radial fan as claimed in claim 4, characterized in that the outer edge of the blades (16) of the blades (13, 14) extend in a radial direction beyond the circumference (15) of the cover disk (11) and the supporting disk (12) of the wheel.

6. Radial fan as claimed in claim 4, characterized in that the blades (13) are curved backwards in relation to the wheel's (3) operating direction of rotation.

7. Radial fan Radial fan as claimed in claim 4, characterized in that the outlet angle (β2) which forms a tangent (T1) at the outer edge (16) of the blade (13, 14) with a tangent (T2) on the circumference (15) of the wheel (3) at a point on the outer edge (16) that is smaller than 35°.

8. Radial fan as claimed in claim 4, characterized in that the inlet angle (□1) which forms a tangent (T3) at the inner edge (18) of the blade (13, 14) with a tangent (T4) on the circumference of the wheel (3) at a point on the inner edge (18) amounts to 17–35°.

9. Radial fan as claimed in claim 4, characterized in that at least a part of the blades (13, 14) is curved in an S-shape when observed from a top view and has an outlet angle (β2) smaller than or equal to 90°.

10. Radial fan as claimed in claim 4, characterized in that shorter (14) and longer (13) blades alternate in their arrangement in the wheel (3).

11. Radial fan as claimed in claim 1, characterized in that the guide edge (20) in lateral projection forms at least one step for which over a section of the guide edge (20) the angle with the bottom reference surface (7) is essentially 90°.

12. Radial fan as claimed in claim 1, characterized in that the guide edge (20) in lateral projection forms at least one plateau for which over a section of the guide edge (20) the angle with the bottom reference surface (7) is essentially 0°.

13. Radial fan as claimed in claim 1, characterized in that the vertical area of the guide edge is 4 mm in height, the plateau extends approximately 12 mm above the bottom reference surface over a distance of approximately 18 mm, the inclined area of the guide edge is 20 mm measured from its beginning at the bottom reference surface to the step and the height from the plateau to the upper end of the guide edge e.g., is 16 mm wherein all measurements refer to a outlet width of approximately 12 mm from the wheel.

14. Radial fan as claimed in claim 1, characterized in that the guide edge (20) has a projection (21).

15. Radial fan as claimed in claim 1, characterized in that the wheel (3) has blades (13, 14) that have a swept-back outer edge (16) along the wheel circumference (13) and the blade tip (17) along the outer edge (16) does not have the same orthogonal distance to the bottom reference surface (7) as the tip of the projection (21) of the guide edge (20).

16. Radial fan as claimed in claim 1, characterized in that the casing has a cover (2) and a air guiding ramp (25) is arranged on the cover (2) that produces a continuous transition between cover (2) and exhaust (5).

17. Radial fan as claimed in claim 1, characterized in that the cover disk of the wheel has an axially placed air inlet port (3*a*) and the cover disk (3) on the edge (3*b*) of the air inlet port is bulged in an axial direction to the casing and a U-shaped profile (31) is provided at the circumference of the air inlet that engages with the edge (3*b*) of the air inlet port (3*a*) forming a seal.

18. Radial fan as claimed in claim 1, characterized in that the bottom of the hollow cylindrical cup-shaped section (9) has e.g., an inclined, corrugated or curved shape that deviates from a straight plane.

19. Radial fan as claimed in claim 1, characterized in that the wheel has bore holes in the supporting disk (12) in the vicinity of the root of the blower to produce low pressure behind the supporting disk.

* * * * *

UNITED STATES PATENT AND TRADEMARK OFFICE

CERTIFICATE OF CORRECTION

PATENT NO. : 7,179,050 B2
APPLICATION NO. : 10/807526
DATED : February 20, 2007
INVENTOR(S) : Reinhold Hopfensperger It is certified that error appears in the above-identified patent and that said Letters Patent is hereby corrected as shown below:

Col. 8, line 12, "□ 2" should be --ß2--

Col. 8, line 18, "□ 1" should be --ß1--

Col. 9, line 11, claim 7, delete "2nd occurrence of "Radial fan"

Col. 9, line 17, claim 8, "□ 1" should be --ß1--

Col. 10, line 6, claim 13, "a" should be --an--

Signed and Sealed this

Twenty-seventh Day of November, 2007

JON W. DUDAS
*Director of the United States Patent and Trademark Office*